US006747622B2

(12) United States Patent
Takahashi et al.

(10) Patent No.: US 6,747,622 B2
(45) Date of Patent: Jun. 8, 2004

(54) LIQUID CRYSTAL DISPLAY DEVICE

(75) Inventors: Hiroyuki Takahashi, Funabashi (JP); Toshimitsu Matsudo, Shinagawa (JP); Akifumi Kishino, Chiba (JP)

(73) Assignee: Hitachi, Ltd., Tokyo (JP)

( * ) Notice: Subject to any disclaimer, the term of this patent is extended or adjusted under 35 U.S.C. 154(b) by 121 days.

(21) Appl. No.: 10/053,902

(22) Filed: Jan. 24, 2002

(65) Prior Publication Data

US 2002/0097209 A1 Jul. 25, 2002

(30) Foreign Application Priority Data

Jan. 24, 2001 (JP) ..... 2001-015593

(51) Int. Cl.[7] ..... G09G 3/36

(52) U.S. Cl. ..... 345/87; 345/88; 345/89; 345/92; 345/94; 345/96; 345/98; 345/100; 345/205; 345/206; 345/207; 345/208; 345/209; 345/211; 345/212

(58) Field of Search ..... 345/87–89, 92, 345/96, 98, 94, 100, 205–209, 211, 212

(56) References Cited

U.S. PATENT DOCUMENTS 6,396,485 B1 * 5/2002 Minami ..... 345/204

6,642,916 B1 * 11/2003 Kodama et al. ..... 345/100

* cited by examiner

*Primary Examiner*—Regina Liang
*Assistant Examiner*—Jennifer T. Nguyen
(74) *Attorney, Agent, or Firm*—Reed Smith LLP; Stanley P. Fisher, Esq.; Juan Carlos A. Marquez, Esq.

(57) ABSTRACT

The present invention suppresses the increase of consumptive electricity derived from the alternation timing driving of a passive matrix type liquid crystal display device such as an STN system or the like. According to the present invention, the liquid crystal display device which is driven by applying selection voltages to common electrodes during a scanning period of the common electrodes and by applying non-selection voltages during other periods to the common electrodes includes a switching circuit which temporarily short-circuits the common electrode n and the common electrode m during a period shifting from the scanning period of the common electrode n to the scanning period of the common electrode m which succeeds the scanning period of the common electrode n, and makes use of the charge stored in the common electrode n by the application of the selection voltage during the scanning period of the common electrode n for charging the common electrode m.

5 Claims, 15 Drawing Sheets

FIG. 15A
Prior Art
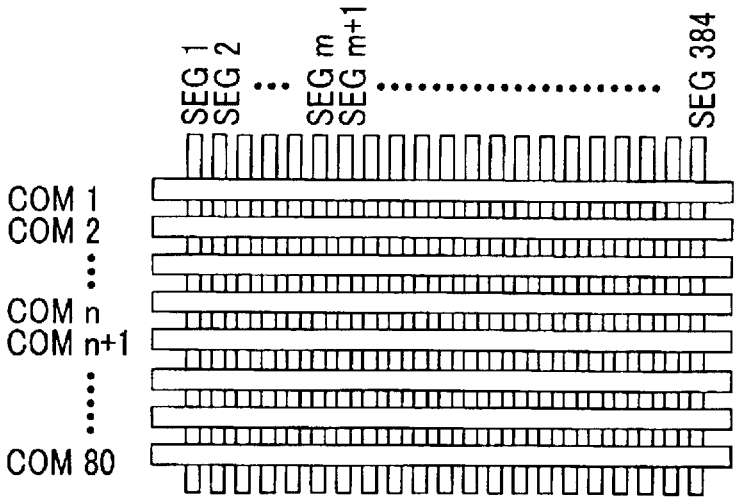
FIG. 15B
Prior Art
FIG. 15C
Prior Art
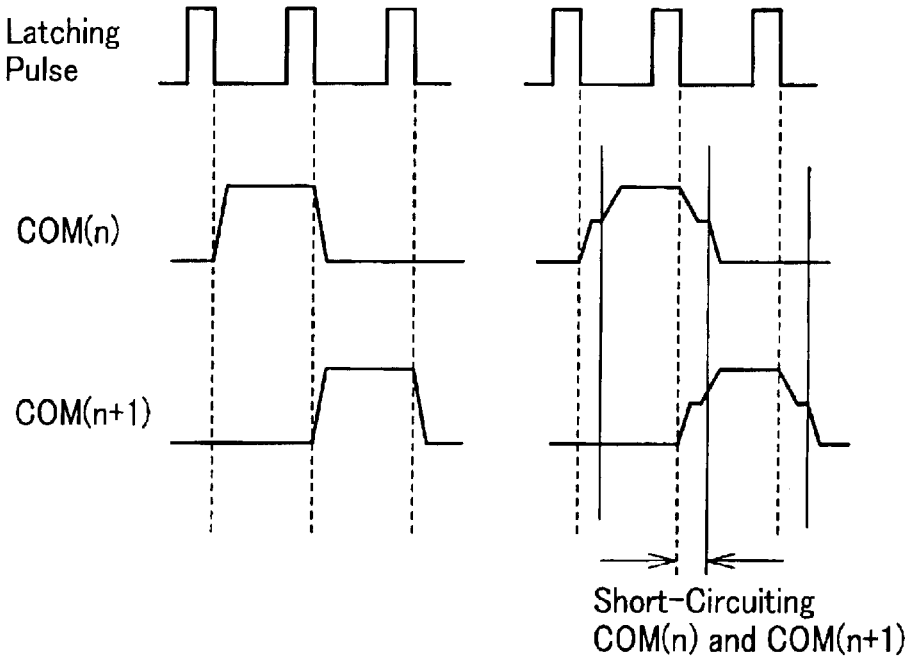
Driving Waveform 1 of Conventional Technique
Driving Waveform 2 of Conventional Technique

LIQUID CRYSTAL DISPLAY DEVICE

BACKGROUND OF THE INVENTION

1. Field of the Invention

The present invention relates to a liquid crystal display device, and more particularly, to a liquid crystal display device which can reduce driving power for cell selection and a method for driving the liquid crystal display device.

2. Description of the Related Art

In a liquid crystal display device which uses an STN (Super Twisted Nematic) type liquid crystal panel, pixel driving signals, that is, driving signals for selecting respective cells of the liquid crystal panel include segment signals which constitutes selection signals (scanning signals) and another segment signals indicative of display data. These driving signals are supplied as so-called alternating signals which have respective potentials thereof inverted periodically.

FIG. 14 is a schematic view for explaining a driving system of a passive matrix type liquid crystal panel which represents an STN (Super Twisted Nematic) type liquid crystal panel. The liquid crystal panel LCD forms pixels, that is, cells at portions where a plurality of common electrodes COM which are formed in the left-and-right direction in the drawing and a large number of segment electrodes SEG which are formed in the up-and-down direction intersect each other.

Scanning signals (common signals) are applied to respective common electrodes COM from a common scanning circuit and display signals (segment signals) are applied to respective segment electrodes SEG from a segment scanning circuit, thus enabling the pixels at the portions where both electrodes intersect each other to perform the display. A control circuit CONT generates display control signals in response to display signals, control signals and a power source supplied from external input terminals and applies given signals to a common scanning circuit COMD and a segment scanning circuit SEGD.

FIG. 15A to FIG. 15C are explanatory views of driving waveforms for the STN type liquid crystal panel of the related art, wherein FIG. 15A is a schematic view for explaining an example of an electrode arrangement structure of the common electrodes COM and the segment electrodes SEG which form the cells and FIG. 15B and FIG. 15C show waveform examples of the driving signals.

FIG. 16 is a circuit diagram for generating the driving waveforms shown in FIG. 15B and FIG. 17 is a circuit diagram for generating the driving waveforms shown in FIG. 15C.

In the electrode arrangement shown in FIG. 15A, the respective cells of the liquid crystal panel are formed by eighty pieces (first line to eightieth line) of common electrodes COM1, COM2, . . . COMn, COMn+1, . . . COM80 and 384 pieces of segment electrodes SEG1, SEG2, . . . SEGm, SEGm+1, . . . SEG384.

For example, focusing on the neighboring common electrodes COMn and COMn+1, with respect to the driving waveforms 1 of the conventional technique shown in FIG. 15B, the driving signals applied to the common electrodes COMn and COMn+1 are formed independently from each other.

That is, when the common electrode COMn of nth line is selected at a certain timing and thereafter the common electrode COMn+1 of (n+1)th line is selected at a next timing, a voltage supplied to the common electrode COMn is changed over from a selection voltage to a non-selection voltage, while a voltage supplied to the common electrode COMn+1 is changed over from a non-selection voltage to a selection voltage.

In an output circuit shown in FIG. 16 which outputs the driving waveforms 1 shown in FIG. 15B, Va indicates a first level voltage (high level) which is outputted from the control circuit CONT, Vb indicates a second level voltage (low level) which is outputted from the control circuit CONT, ca1, ca2, . . . caN indicate common electrode selection signals, and SWa1 and Swb1, Swa2 and Swb2, . . . SWaN and SwbN indicate a plurality of pairs of analogue switches which generate outputs ct1 to ctN to the common electrodes COM1, COM2, . . . COMn.

Although the common electrodes are indicated by COM1, COM2, . . . COMn, COMn+1, . . . COM80 in FIG. 15A, to simplify the explanation, the explanation is made hereinafter by indicating the common electrodes with 1 to n. Accordingly, the common electrode COMn indicates COMn, COMn+1, . . . COM80 shown in FIG. 14 in a representing manner.

A plurality of pairs of analogue switches SWa1 and Swb1, Swa2 and Swb2, . . . and SWaN and SWbN apply the output signals ct1 to ctN to the common electrodes 1 to n corresponding to the output signals ct1 to ctN by inputting the first level voltage Va, the second level voltage Vb and the common electrode selection signals ca1, ca2, . . . caN outputted from the control circuit CONT.

In performing the sequential changeover of such voltages, the voltage level of the selected common electrode COMn and that of the selected common electrode COMn+1 shown in FIG. 15B, for example, have polarities inverse to each other. At this point of changeover time, a state in which the charge of the common electrode COMn is fully discharged is established so that a given charge is applied to the common electrode COMn+1 from the non-selected level to the selected level without depending on the voltage level of the common electrode COMn.

Due to such a charging operation, the electric current is consumed so that the liquid crystal panel suffers from the undesired power consumption.

To improve this situation, as shown in FIG. 15C, there has been known a method in which the neighboring common electrodes COMn and COMn+1 are short-circuited at the time of changeover of the voltages.

FIG. 17 is a circuit diagram of a driving system shown in FIG. 15*c* for short-circuiting the neighboring common electrodes at the timing of changing over the common electrodes.

In FIG. 17, swc1 to swcN indicate analogue switches and cb1 to cbN indicate short-circuit signals for controlling the analogue switches swc1 to swcN, wherein symbols used in FIG. 17 which are as same as symbols used in FIG. 16 indicate parts having same functions.

In this system, as shown in FIG. 15C, when the currently selected common electrode is changed over to the non-selection state and the next common electrode is changed over to the selection state from the non-selection state, the currently selected common electrode and the next selected common electrode are short-circuited by the analogue switches swa1 to swcN.

With the provision of such a system, the neighboring common electrodes can hold the mean charge so that the charging current which is supplied to the next selected common electrode is reduced thus achieving the reduction of power consumption. The detailed operation of the above-mentioned output circuit is disclosed in Japanese Laid-open Patent Publication 194314/1999.

SUMMARY OF THE INVENTION

In the liquid crystal display device which uses this kind of liquid crystal panel, it is necessary to alternate the applied voltage so that the direct current voltage is not applied to the liquid crystal panel. FIG. 18 is a driving waveform chart for explaining problems derived from an alternation driving of a conventional technique. In the drawing, FLM indicates a frame signal, M indicates an alteration signal and CL1 indicates latching pulses. Symbols used in FIG. 18 which are as same as symbols used in FIG. 15 indicate parts having same functions.

As shown in FIG. 18, at the timing of the latching pulse CL1, a certain common electrode is selected, and the certain common electrode and another common electrode adjacent thereto (a common electrode to be selected next to the certain common electrode) are short-circuited at the timing of this selection.

However, for example, when the common electrode COMn−1 and the COMn are short-circuited at the timing of the latch pulse n and the common electrode COMn and the COMn+1 are short-circuited at the timing of the latch pulse n+1, the consumptive electricity is increased on the contrary.

Due to the fact that the switching time cannot be made zero with respect to analogue switches, when the short-circuiting occurs, there arises a case in which both analogue switches are turned on. In the constitution of the output circuit described above as the related art, the common electrode is short-circuited with the common electrode to be selected next at the time that the polarities are changed due to the alternation, so long as the scanning line subjected to the common electrode is concerned, a voltage inverse to a voltage to be applied is applied and hence, the consumptive current reduction effect is suppressed. This has constituted one of problems to be solved by the present invention.

As described above, according to the above-mentioned related art, upon receiving the changeover signals for the common electrode selection signals, the terminals (common terminals) of the neighboring common electrodes are connected through the switching action and the charges of the neighboring common electrodes are held at the mean charge. Accordingly, with a given level voltage, the charging current supplied to the common electrode to be selected next can be substantially halved.

However, when the voltage applied to the liquid crystal is alternated, the processing at the time of alternation timing has not been sufficiently considered and hence, the reduction of the consumptive electricity has not been sufficient.

Further, there also exists the possibility of the occurrence of transitional consumptive current during the time required for switching operation of the output circuit.

The present invention has been made to solve following two problems (1), (2) which have not been solved by the related art.

(1) Due to the fact that the switching time of the analogue switches which are formed of a pair of CMS switching elements or the like constituting the common output part (common voltage output circuit) cannot be made zero, both switching elements are simultaneously turned on transitionally and hence, the consumptive electricity is increased.

(2) Since the voltage applied to the liquid crystal panel is of an AC voltage, the consumptive electricity is increased at the timing of alternation.

Accordingly, it is an object of the present invention to provide a liquid crystal display device which can further reduce the driving electricity for selection of cells by taking the operation time of analogue switches into consideration.

To achieve the above-mentioned object, in a liquid crystal display device including (a) a liquid crystal panel which arranges a plurality (for example, $n_N$) of common electrodes extending in the first direction in parallel on one of a pair of substrates which sandwich a liquid crystal layer therebetween and arranges a plurality of segment electrodes extending in the second direction which intersects the first direction in parallel on the other of a pair of these substrates, (b) a common driver having a common voltage output part which applies scanning signals to a plurality of respective common electrodes, and (c) a segment driver having a segment voltage output part which applies data signals which correspond to display data to a plurality of respective segment electrodes, the common driver is configured to have following functions.

Function 1: In a period in which data signals are applied to a plurality of above-mentioned segment electrodes, selection periods are sequentially allocated to a plurality of respective common electrodes, and a selection voltage is applied to one of a plurality of common electrodes to which non-selection voltages are applied as scanning signals. The period in which the data signals are applied to a plurality of segment electrodes is also referred to as "scanning period". During this period, for example, the data signals are collectively supplied to respective segments which contribute to an image display among a plurality of segment electrodes. The allocation of selection periods is performed by inputting common electrode selection signals for selecting the given common electrode (of $n_M$th line . . . $1 \leqq n_M \leqq n_N$) to a common driver from an external circuit, for example. In the specification of this application, although the common electrode selection signal is exemplified as CAM as will be explained later, M indicates a number (natural number of 2 or more) which indicates an order (time-sequential order) for selecting the given common electrode in a step for sequentially selecting a plurality of above-mentioned common electrodes (operation of the above-mentioned liquid crystal panel). M is not a value which always corresponds to a position (for example, the above-mentioned $n_M$th line) of the given common electrode in the arrangement of a plurality of above-mentioned common electrodes (spatial or geometric arrangement in the liquid crystal panel). When the selection periods for selecting respective common electrodes are N times (N being a natural number) within the above-mentioned scanning period, the natural number M becomes also equal to or less than N.

Function 2: In applying the above-mentioned scanning signal to the given common electrode (hereinafter described as the $n_M$th (spatial position) common electrode to which the Mth selection period (time-sequential order) is allocated among a plurality of above-mentioned common electrodes, the voltages are applied in the order that the application of the non-selection voltage is stopped at the first time at which the Mth selection period is started, the application of the selection voltage is started from the second time which comes after the first time, the application of the selection voltage is stopped at the third time at which the Mth selection period expires (coming after the second time), and the application of the non-selection voltage is started from the fourth time which comes after the third time. To explain the non-selection voltage (described as Vm later) in conjunction with a normally black type liquid crystal display device which makes light pass through a liquid crystal layer by applying an electric field to the liquid crystal layer as an example, the liquid crystal layer which is sandwiched between the common electrode to which the non-selection voltage is applied and the segment electrode which faces the common electrode in an opposed manner becomes a light shielding state so that pixels which correspond to the liquid crystal layer exhibits a so-called black display. To the contrary, when the selection voltage is applied to the common electrode, the liquid crystal layer which is sandwiched between the common electrode and the segment electrode which faces the common electrode in an opposed manner becomes a light transmitting state so that pixels which correspond to the liquid crystal layer exhibits a white display, for example. The selection voltage is comprised of a voltage (described as VL later) which has a potential lower than that of the above-mentioned non-selection voltage and a voltage (described as VH later) which has a potential higher than that of the above-mentioned non-selection voltage. By alternately applying either one of these voltages to a plurality of respective common electrodes at a given interval (INTERVAL), the polarization of the liquid crystal layer and the deterioration of the liquid crystal layer derived from the polarization can be prevented.

Function 3: The selection polarity of the selection voltage in the Mth selection period for the non-selection voltage and the polarity of the selection voltage which is applied to the $n_M$th common electrode to which M'th selection period (M' being a natural number which satisfies $1 \leqq M' < M$) coming before the Mth selection period is allocated are compared each other. In the specification of the present application, when the selection voltage in the Mth selection period and the selection voltage in the M'th selection period are both lower than the non-selection voltage (for example, when both selection voltages are VL) or when these voltages are both higher than the non-selection voltage (for example, when both selection voltages are VH), both selection voltages are defined as voltages having the same polarity, while either one of the selection voltage in the Mth selection period and the selection voltage in the M'th selection period is lower than the non-selection voltage and the other selection voltage is higher than the non-selection voltage (for example, when one selection voltage being VL and the other selection voltage being VH), both selection voltages are defined as voltages having polarities opposite to each other. Here, M' which specifies the M'th selection period which comes before the Mth selection period indicates a number (natural number) which indicates a time-sequential order for selecting the $n_M$th common electrode in a step for sequentially selecting a plurality of above-mentioned common electrodes in the same manner as the above-mentioned M. M' is not a value which always corresponds to the given numbering $n_{M'}$ (natural number) of the given common electrode in the spatial arrangement of a plurality of the above-mentioned common electrodes in the liquid crystal panel. Not only with respect to the liquid crystal display device but also with respect to a display device in general of a passive matrix driving system which uses organic EL elements or field emission type electron sources, the above-mentioned natural number M' can take arbitrary numerical values which are smaller than the natural number M. However, to focus on only the liquid crystal display device, it is desirable that the above-mentioned natural number M' satisfies the relationship [M'=M−1] with respect to the above-mentioned natural number M. In the following explanation, the description is made by replacing the above-mentioned natural number M' with the natural number (M−1) and by adopting the present invention as a desirable application example to the liquid crystal display device. However, it becomes possible to replace the following natural number (M−1) with the natural number M'. Further, the natural number $n_{M'}$ is also expressed as the natural number $n_{M-1}$ hereinafter. Here, when a plurality of the above-mentioned common electrodes are constituted of $n_N$ pieces of common electrodes, the above-mentioned natural number $n_{M'}$, can be set to an arbitrary value which falls in a range of $[1 \leqq n_{M'} \leqq n_N]$. However, as described previously in conjunction with the function 1, the time-sequential order of the selection periods among the common electrodes and the geometric arrangement among display elements do not always agree with each other. Accordingly, it is impossible to univocally determine the magnitude relationship between $n_{M'}$ and $n_M$ and the magnitude relationship between $n_{M-1}$ and $n_M$.

Function 4: In comparison with the function 3, when it is judged that the selection voltage in the Mth selection period and the selection voltage in the (M−1)th selection period have the same polarity, a portion of the common voltage output part which corresponds to the $n_M$th common electrode and a portion of the common voltage output part which corresponds to the $n_{M-1}$th common electrode are short-circuited during the period between the first time and the second time.

Function 5: In comparison with the function 3, when it is judged that the selection voltage in the Mth selection period and the selection voltage in the (M−1)th selection period have the reversed polarities, during the period between the first time and the second time, a portion of the common voltage output part which corresponds to the $n_M$th common electrode and a portion of the common voltage output part which corresponds to the $n_{M-1}$th common electrode are not short-circuited.

In the liquid crystal display device of the present invention which is characterized by the above-mentioned functions, the supply of the selection voltage to the $n_M$th common electrode to which the Mth selection period is allocated is started at the second time which comes after the first time at which the common electrode selection signal which selects the $n_M$th common electrode is generated. Further, the supply of the selection voltage to the $n_M$th common electrode is finished at the fourth time which comes after the third time at which the common electrode selection signal which selects the $n_M$th common electrode is extinguished. However, due to the function 4 of the present invention, when the selection voltage which is supplied to the $n_M$th common electrode and the selection voltage which is applied to the $n_{M-1}$th common electrode in the preceding selection period have the same polarity, the charge remaining in the $n_{M-1}$th common electrode which has finished the selection period is processed by short-circuiting the common voltage output part (one of ct1 to ctN which will be explained later, here referred to as ct(M−1)) which is connected to the $n_{M-1}$th common electrode and the common voltage output part (the other one of ct1 to ctN which will be explained later, here referred to as ctM) which is connected to the $n_M$th common electrode. Here, the respective potentials of the common voltage output part ct(M−1) and the common voltage output part ctM are changed to the mean value between the selection voltage and the non-selection voltage. Accordingly, the charge corresponding to the potential of the mean value is preliminarily supplied to the $n_M$th common electrode from the $n_{M-1}$th common electrode. Accordingly, the undesired charge in the $n_{M-1}$th common electrode is effectively used for charging the $n_M$th common electrode and hence, the electricity which is consumed at the time of selecting the cell (pixel) corresponding to the $n_M$th common electrode can be saved by such a charged amount. Here, the short-circuiting of the common voltage output part ct(M−1) and the common voltage output part ctM is performed by providing a short-circuiting line which short-circuits both common voltage output parts and by mounting a switching element (swcM which will be explained later) on the short-circuiting line.

On the other hand, due to the above-mentioned function 5 of the present invention, when the polarity of the selection voltage which is supplied to the $n_M$th common electrode and the polarity of the selection voltage applied to the $n_{M-1}$th common electrode in the preceding selection period are opposite to each other, the common voltage output part ct(M−1) and the common voltage output part ctM are not short-circuited. This is because that when the potential of the $n_M$th common electrode is changed to the mean value between the selection voltage and the non-selection voltage of the $n_{M-1}$th common electrode due to the short-circuiting of both common electrodes, the supply of charge for compensating for the change amount of the mean value becomes necessary newly at the time of setting the potential of the $n_M$th common electrode to the selection voltage during the selection period. This reason is also substantiated by the fact that when the selection voltage to be supplied to the $n_M$th common electrode charges electrons as the charge to the common electrode, the selection voltage of the $n_{M-1}$th common electrode which has the polarity opposite to the polarity of the $n_M$th common electrode charges holes as the charge to the common electrode (to reduce the density of electrons of the common electrode). Accordingly, the function 5 of the present invention also can contribute to the reduction of the electricity consumed by the selection of the cell corresponding to the $n_M$th common electrode.

In the present invention, for the selection start time of the $n_M$th common electrode (the above-mentioned first time), the time for applying the selection voltage through a power source line (the above-mentioned second time) to this is delayed by a given time and the charge is introduced into the $n_M$th common electrode from the separate common electrode in such a given time. Further, in the present invention, for the selection finish time of the $n_M$th common electrode (the above-mentioned third time), the time for applying the non-selection voltage through a power source line (the above-mentioned fourth time) to this is delayed by a given time and the charge remaining in the $n_M$ th common electrode is distributed to a separate common electrode in such a given time. Accordingly, apart from the selection signal CAM of the $n_M$th common electrode, it is required that a control signal which is delayed at a given interval is generated and, in response to the control signal, the $n_M$th common electrode and the power source line which supplies the selection voltage are connected with each other at the second time, and the $n_M$th common electrode and a power source line which supplies the non-selection voltage are connected at the fourth time. In this case, it is preferable to generate this control signal (referred to as CAM⁻later) by delaying the selection signal for the $n_M$th common electrode. Further, the control signal which makes a switching element provided to a short-circuiting line which short-circuits the above-mentioned common voltage output parts conductive (referred to as CAM' later, wherein M' included in CAM' differs from the above-mentioned natural number M') and the control signal (referred to as CAM" later) which interrupts the switching element may be generated by delaying the selection signal of the $n_M$th common electrode. These three kinds of control signals can be accurately generated using a simple circuit constitution by arranging delay circuit blocks in three stages at the rear stage of the output part of the selection signal CAM to the $n_M$th common electrode, wherein the control signal CAM' which makes the switching element of the short-circuiting line conductive is taken from the first-stage output, the control signal CAM" which interrupts the switching element of the short-circuiting line is taken from the second-stage output, and the selection signal CAM of the $n_M$th common electrode and the AND condition are taken from the output of the third stage so that the $n_M$th common electrode and the power source line of the selection voltage are communicated with each other, and the selection signal CAM and the NOR (NOTOR) condition are taken so as to generate respective control signals CAM⁻which make the $n_M$th common electrode and the power source line of the non-selection voltage communicate with each other.

In any liquid crystal display devices of the present invention which have been explained heretofore, it becomes possible to drastically reduce the consumptive electricity which is necessary at the time of performing a so-called alternation timing driving which operates the liquid crystal display device by inverting the polarity of the selection voltage applied to the common electrode with respect to the non-selection voltage compared with the conventional liquid crystal display device. As a result, by mounting the liquid crystal display device of the present invention on the portable telephone, the portable information terminal or the like which has the small battery capacitance, the operable time which corresponds to the charging time of such equipment can be prolonged. To take the portable telephone as an example, a product having the same charge capacitance and the same standby time (product assurance value) with a conventional product can be constituted far lighter than the conventional product.

In the above-mentioned liquid crystal display device according to the present invention, it is preferable that the common voltage output part which corresponds to the $n_M$th common electrode and the common voltage output part which corresponds to the $n_{M-1}$th common electrode are configured to be short-circuited at the time after the first time and before the second time. Further, in the liquid crystal display device according to the present invention, it is preferable that the period in which the common voltage output part which corresponds to the $n_M$th common electrode and the common voltage output part which corresponds to the $n_{M-1}$th common electrode are short-circuited expire are configured to after the third time and before the fourth time. In this manner, by delaying the timing of the starting of short-circuiting between the common voltage output parts more than the first time or the third time and by advancing the timing of the finishing of short-circuiting between the common voltage output parts more than the second time or the fourth time, it becomes possible to surely prevent the mixing of noise voltage into the power source line due to the unexpected delay of the open/close timing of the switching element provided between the common voltage output parts and the power source line which supplies the selection voltage or the non-selection voltage.

Further, in the above-mentioned liquid crystal panel which constitutes the liquid crystal display device of the present invention, the $n_M$th common electrode and the $n_{M-1}$th common electrode may be arranged adjacent to each other (spatially) or the $n_M$th common electrode and the $n_{M-1}$th common electrode may be arranged in a spaced-apart manner. This is substantiated by the explanation of the function 1 and the function 3 of the liquid crystal display device of the present invention. That is, as has been explained by taking the $n_M$th common electrode and the $n_{M-1}$th common electrode as examples, the order of the respective selection period of a plurality of common electrodes is not constrained by the order of the spatial arrangement thereof. Here, the constitution which arranges the $n_M$th common electrode and the $n_{M-1}$th common electrode in the spaced-apart manner is put into practice in the liquid crystal display device or the like which adopts a toggle type driver as a common driver.

The liquid crystal display devices whose summaries have been explained heretofore are not limited to the above-mentioned constitutions and constitutions of embodiments which will be explained hereiafter and it is needless to say that various modifications can be made without departing from the technical concept of the present invention.

BRIEF DESCRIPTION OF THE DRAWINGS

FIG. 15A to FIG. 15C are explanatory views of driving waveforms of the STN type liquid crystal panel of the related art, wherein FIG. 15A shows an example of an electrode structure of the STN type liquid crystal panel and FIG. 15B and FIG. 15C show the respective driving waveforms at the electrode arrangement shown in FIG. 15A;

DETAILED DESCRIPTION

Embodiments of a liquid crystal display device according to the present invention are explained in detail in conjunction with drawings which show such embodiments hereinafter.

Figure 1:
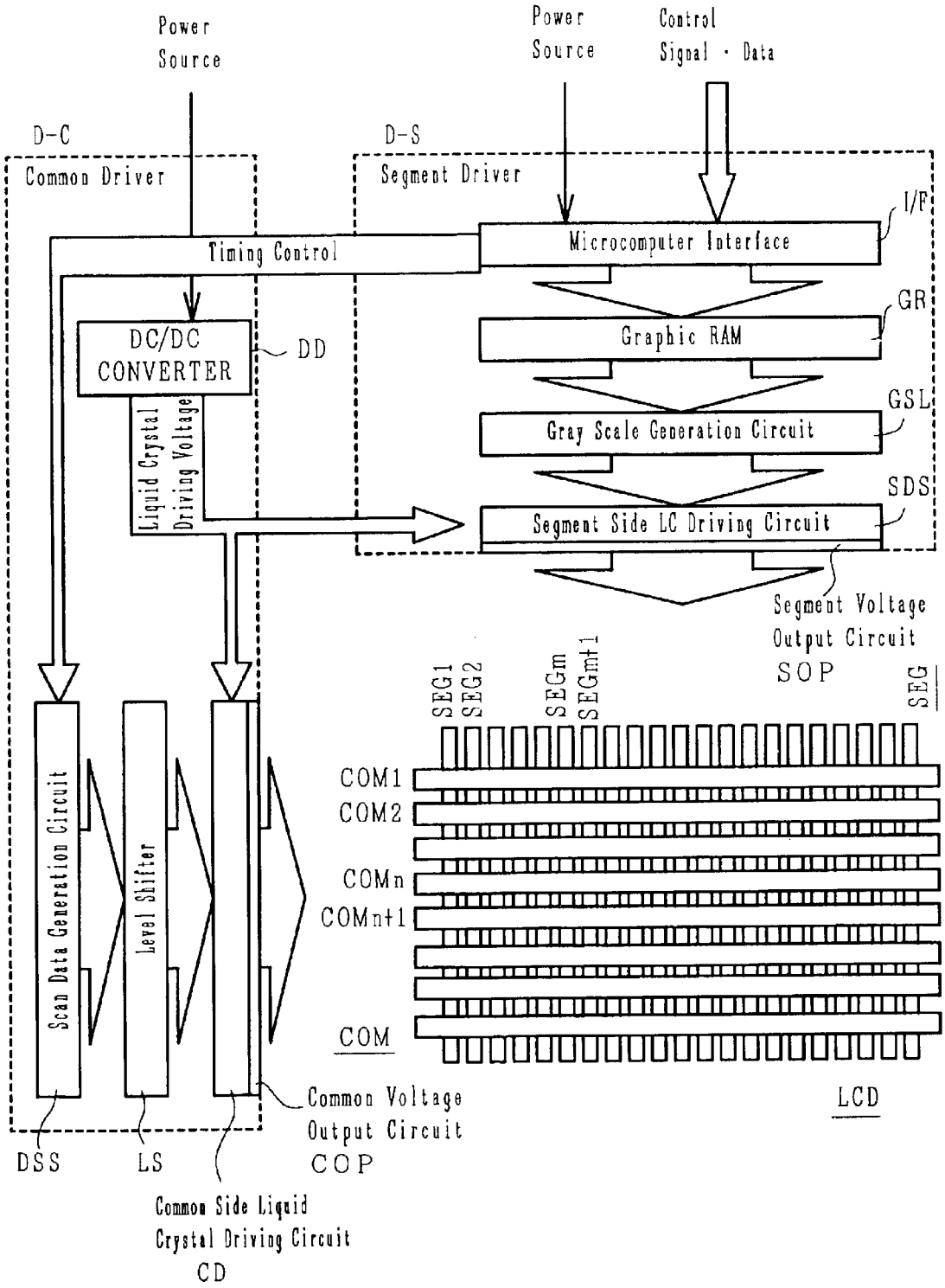
FIG. 1 is a block diagram for explaining an overall constitution of a driving circuit of a liquid crystal display device according to the present invention.

FIG. 1 is a block diagram for explaining the overall constitution of a driving circuit of a liquid crystal display device according to the present invention. In the drawing, LCD indicates a liquid crystal panel which includes a plurality of common electrodes COM (COM1, COM2, . . . $COM_N$, $COM_{N+1}$ . . . ) and a plurality of segment electrodes SEG (SEG1, SEG2, . . . SEG $_M$, SEG $_{M+1}$).

A common driver D-C which drives the common electrodes COM includes a scan data generation circuit (scanning signal generation circuit) DSS, a level shifter LS, a common-side liquid crystal driving circuit CD and a DC/DC converter DD. The common-side liquid crystal driving circuit CD includes a common voltage output circuit COP.

A segment driver D-S which drives the segment electrodes SEG includes an interface circuit I/F(microcomputer interface, also abbreviated as "mi-con interface") for receiving control signals, data (display data) and a power source which are inputted from an external host computer (microcomputer, also abbreviated as "mi-con"), a graphic RAM (GR), a gray scale generation circuit GSL, and a segment-side liquid crystal driving circuit SDS. The segment-side liquid crystal driving circuit SDS includes a segment voltage output circuit SOP.

A DC/DC converter DD of the common driver D-C generates a power source voltage necessary for the common driver D-C and the segment driver D-S from a power source voltage inputted from the outside. Timing signals generated by the microcomputer interface I/F are used by the segment driver D-S and the common driver D-C.

Figure 2:
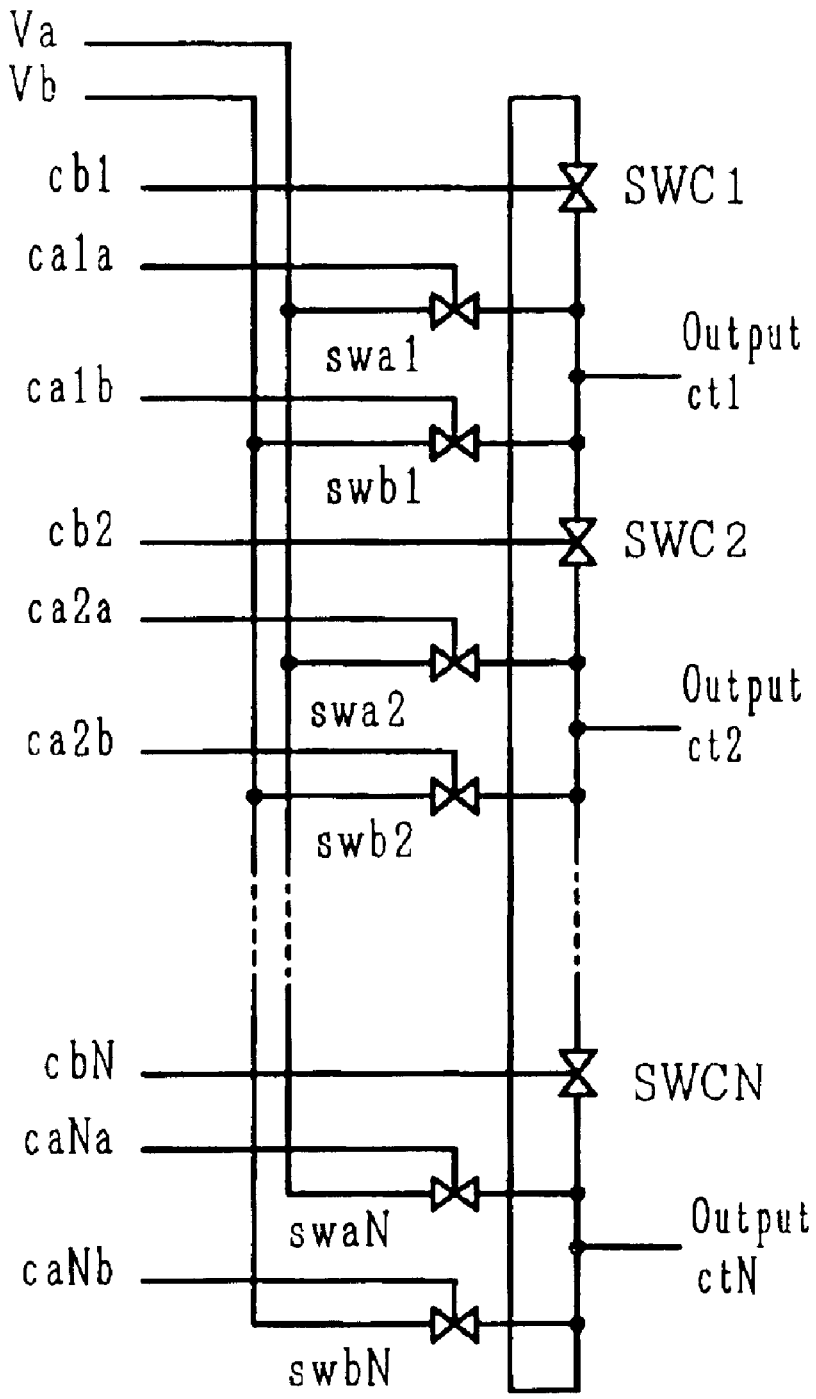
FIG. 2 is a circuit constitutional view of a common voltage output part which is provided to a common output circuit which is served for explaining the first embodiment of the present invention.
Figure 3:
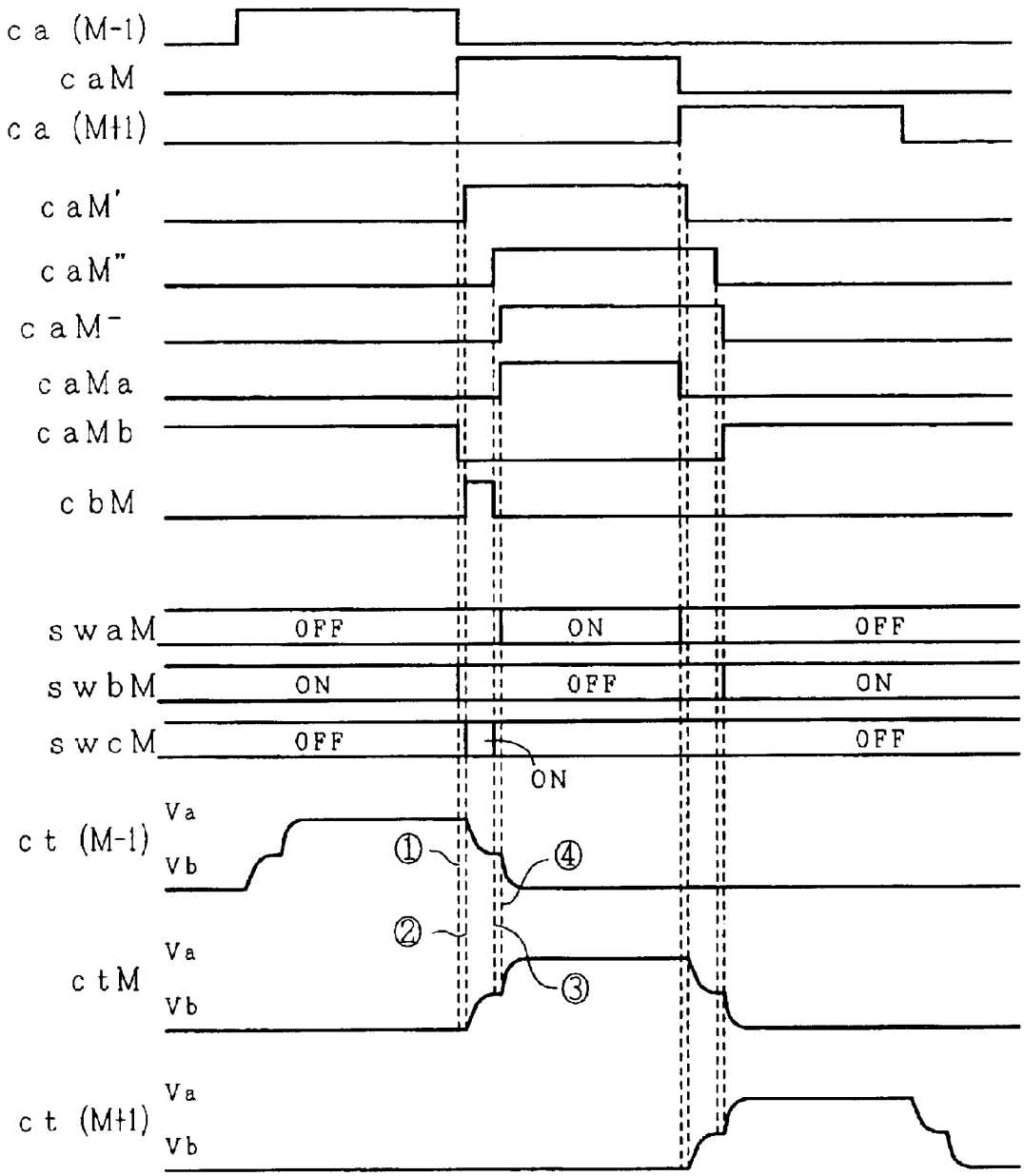
FIG. 3 is an operational waveform chart of the common output circuit which is served for explaining the first embodiment of the present invention.
Figure 4:
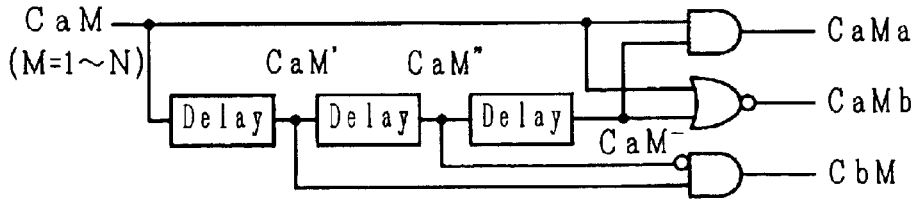
FIG. 4 is a circuit diagram for generating waveforms shown in FIG. 3.

FIG. 2 is a circuit constitutional view of a common voltage output part which is provided to a common output circuit for explaining the first embodiment of the present invention. FIG. 3 is an operational waveform chart of common electrodes. FIG. 4 is a circuit diagram for generating waveforms shown in FIG. 3. Circled numbers in the following description correspond to timings indicated by the same circled numbers in FIG. 3.

In FIG. 2 to FIG. 4, Va indicates a selection voltage, Vb indicates a non-selection voltage and caM indicates a common electrode selection signal of Mth line generated by the scan data generation circuit DS. This common electrode selection signal caM generates delay signals caM', caM", caM⁻matched with the selection start timing of the common electrode of Mth line in a delay circuit shown in FIG. 4 (indicated as "Delay" in FIG. 4).

These delay signals and common electrode selection signals caM are outputted as level selection control signals caMa, caMb, cbM which are delayed through an AND circuit, a NOR circuit and a NAND circuit shown in FIG. 4.

The level selection control signals caMa, caMb, cbM are respectively inputted to a common voltage output circuit COP of the common-side liquid crystal driving circuit CD (for example, when M=2, in the order of ca2*a*, ca1*b*, cb2). When the common electrode of (M−1)th line is selected, the level selection control signal ca(M−1)a becomes high level (High) and only an analogue switch swa(M−1) is turned on and hence, the voltage Va (=High: high level) is applied to the common electrode of (M−1)th line. With respect to the other common electrodes, the level selection control signals caMb (here, M=1 to N, wherein the above-mentioned (M−1) is excluded) become high level and analogue switches swbM corresponding to the level selection control signals caMb become the "ON" state and hence, the voltage Vb (=Low: low level) is applied to these other common electrodes.

The outputting of voltages when (M−1)=1, for example, is explained in conjunction with FIG. 2. First of all, (1) when a latching pulse CL1 (FIG. 5) selects an Mth line (specified line adjacent to the above-mentioned (M−1)th line), the common electrode selection signal caM is inputted to the level shifter LS shown in FIG. 1. Although the above-mentioned delayed level selection control signals caMb from the level shifter LS which is changed to the low level turns off the analogue switch swbM, the potential of the common electrode is held at the same level when the common electrode of (M−1)th line is selected. Here, the delayed output ca(M−1)a is changed to the low level by the common electrode selection signal ca(M−1) and the analogue switch swa(M−1) is turned off.

Subsequently, (2) the delayed level selection control signal cbM which is changed to the high level turns on the analogue switch swcM and hence, the charge of the common electrode of (M−1)th line is gradually made to flow into the common electrode of Mth line so that both of these common electrodes approach a given potential.

Then, (3) the level selection control signal cbM returns to the low level in response to the delayed level selection control signal caM" and the analogue switch swcM is turned off so that the potentials of the common electrodes of (M−1)th line and Mth line are held at some level for a while. Subsequently, (4) the level selection control signal caMa which is changed to the high level turns on the analogue switch swam and hence, the voltage Va is applied to the common electrode of Mth line. On the other hand, the delayed output ca(M−1)b is changed to the high level and turns on the analogue switch swb(M−1) at the substantially same timing and hence, the voltage Vb is applied to the common electrode of (M−1)th line.

In the above-mentioned cases (1) and (3), by temporarily turning off the common electrodes of (M−1)th line and Mth line whose power source level can be changed by separating these common electrodes from the power source, the simultaneous connection of a plurality of power supplies to one electrode can be prevented.

Figure 5:
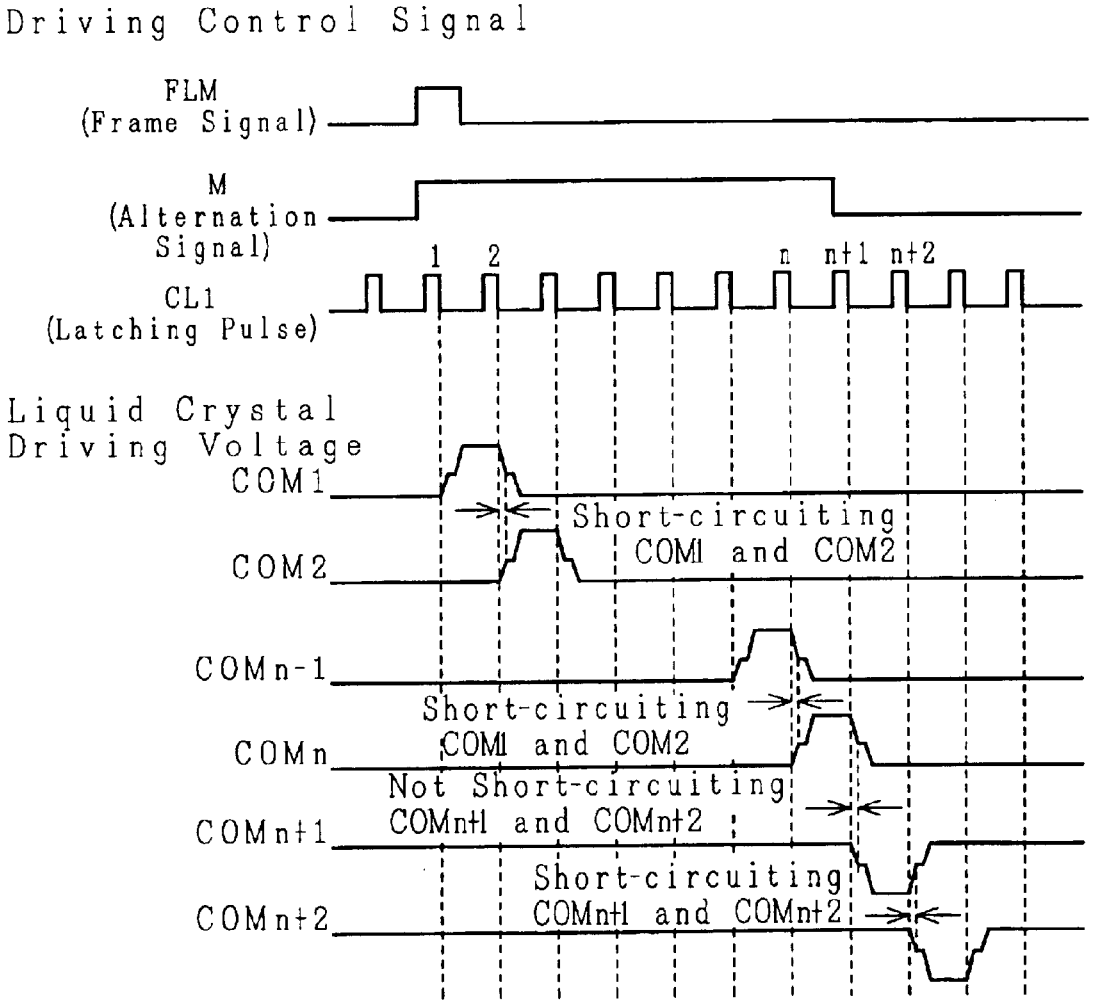
FIG. 5 is a waveform chart showing waveforms when common electrodes are short-circuited only at proper timings in the alternation driving which is served for explaining the second embodiment of the present invention.
Figure 6:
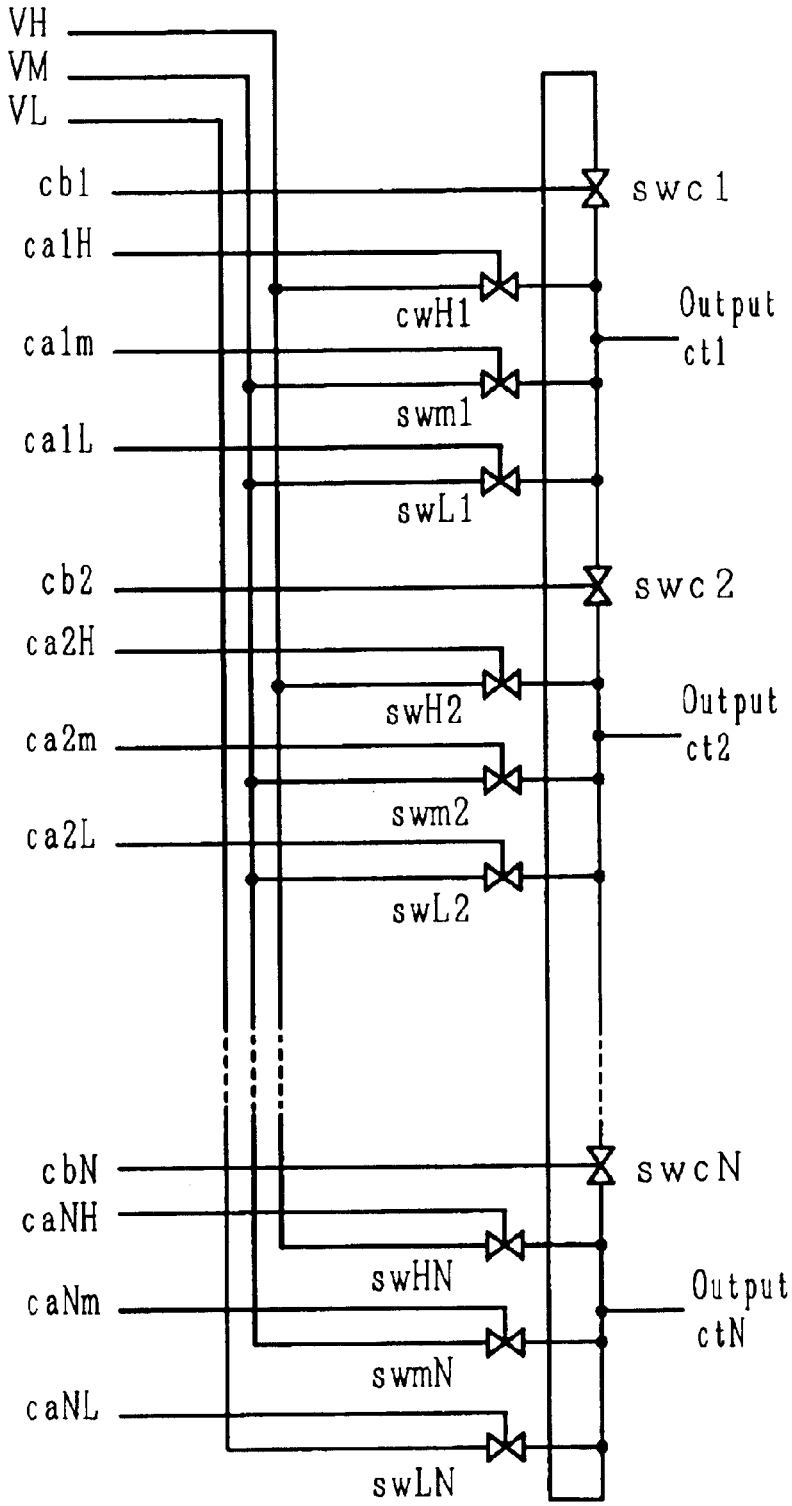
FIG. 6 is a circuit constitutional view of a common voltage output part which is provided to a common output circuit which is served for explaining the second embodiment of the present invention.
Figure 18:
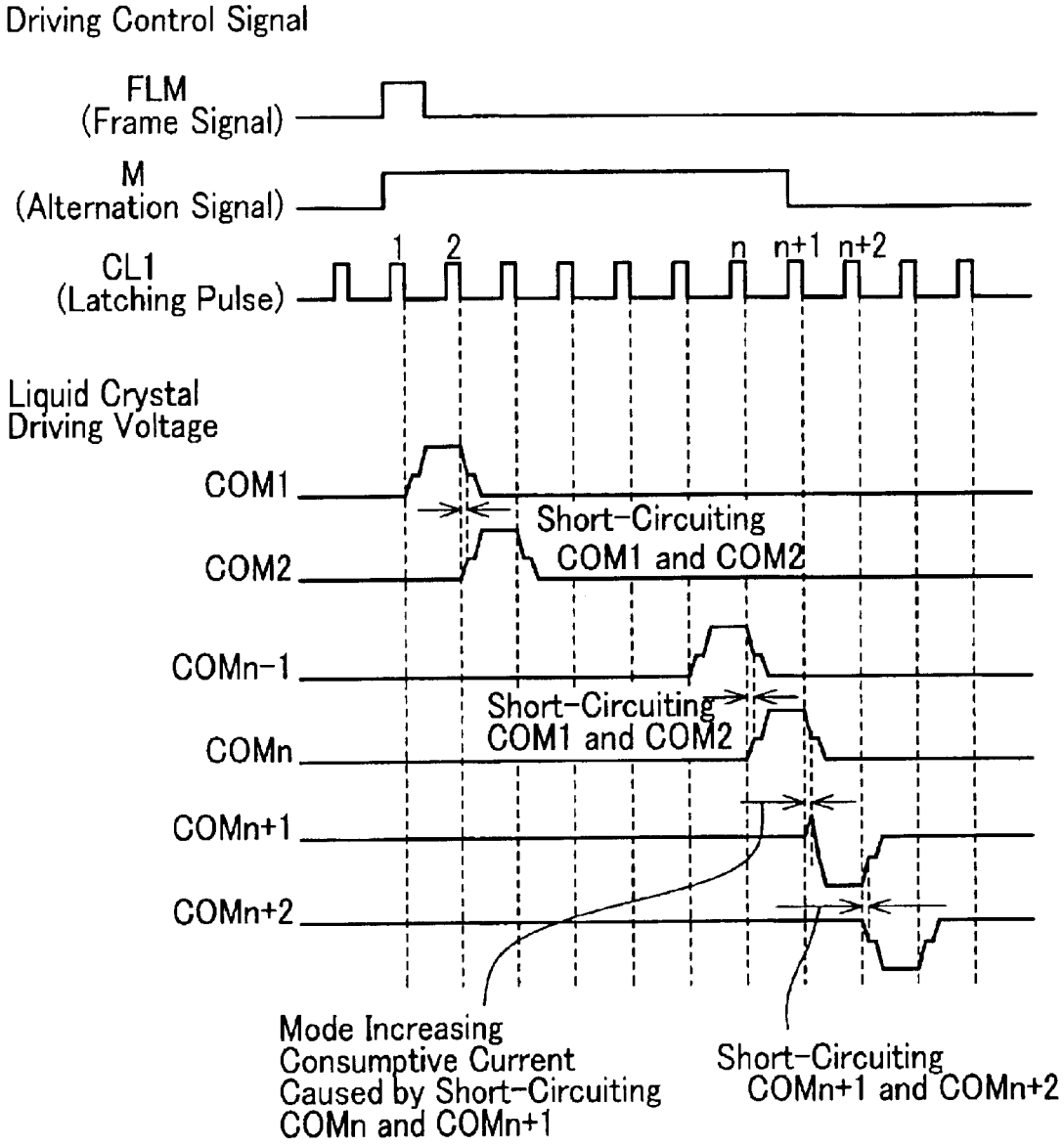
FIG. 18 Prior Art
FIG. 18 is a driving waveform chart for explaining problems with respect to the alternation driving in the related art.

FIG. 5 is a waveform chart when the common electrodes are short-circuited only at the proper timing in the alternation driving for explaining the second embodiment of the present invention. The drawing shows the timing waveform for solving the problems inherent to the alternation driving which has been explained in conjunction with FIG. 18. Further, FIG. 6 is a circuit constitutional view of a common voltage output part provided to a common output circuit, FIG. 7 is a circuit diagram for generating waveforms shown in FIG. 5, and FIG. 8 is an operational waveform chart of the common voltages shown in FIG. 7.

In FIG. 5, FLM indicates a frame signal, M indicates an alternation signal (common electrode polarity selection signal), CL1 indicates latching pulses, COM1, COM2 to COMn−1, COMn, COMn+1, COMn+2 indicate liquid crystal driving voltages (common electrode driving voltages).

In these timing waveforms, the latches are provided in two stages in the liquid crystal driving circuit and, when the polarity for alternation is not changed, the potentials of two lines are averaged by short-circuiting the neighboring common electrodes (COM1 and COM2, COMn−1 and COMn in the drawing). On the other hand, when the polarity for alternation is changed, the neighboring common electrodes (COMn+1 and COMn+2 in the drawing) are not short-circuited.

Figure 7:
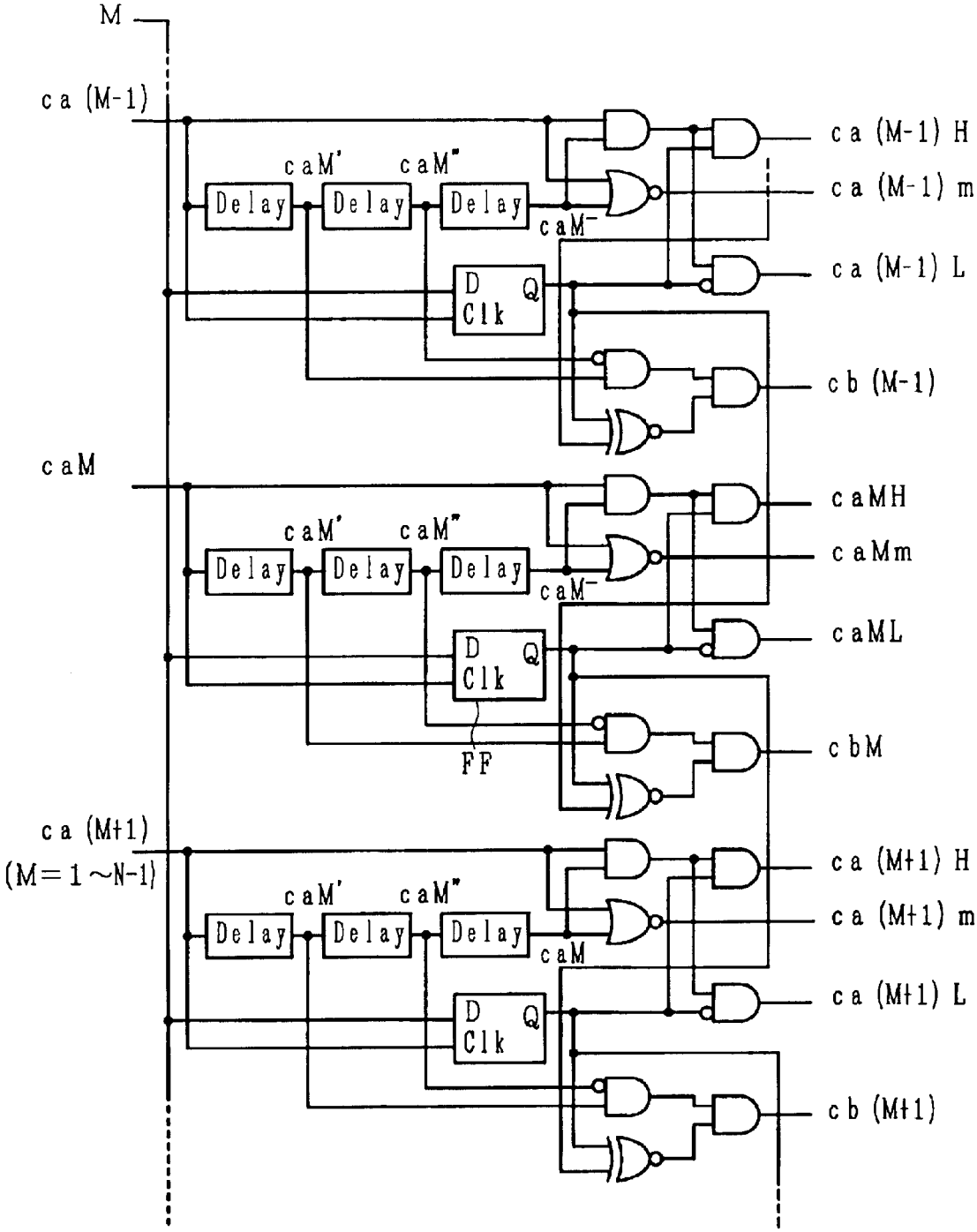
FIG. 7 is a circuit diagram for generating waveforms shown in FIG. 5.
Figure 8:
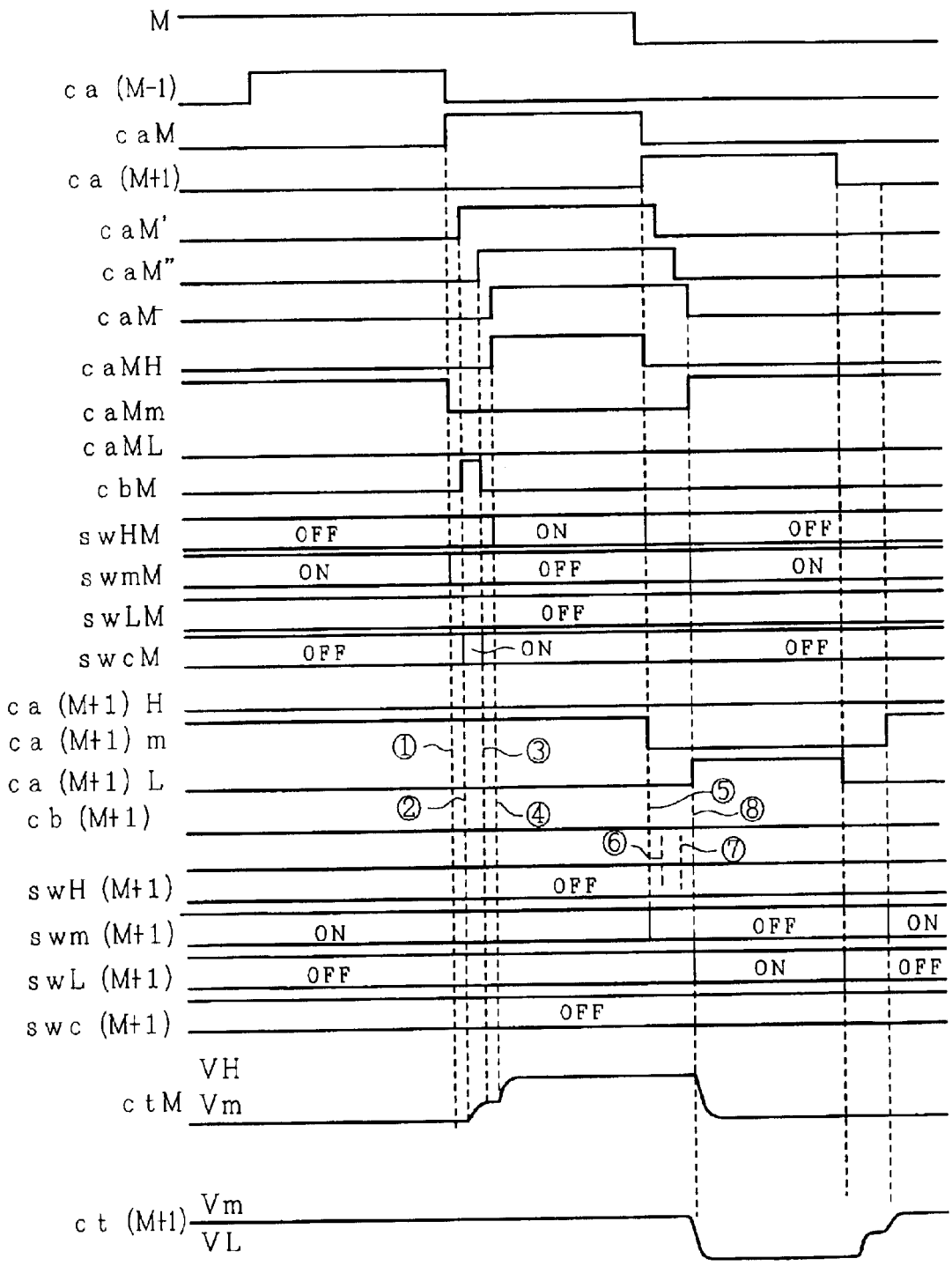
FIG. 8 is an operational waveform chart of the circuit shown in FIG. 7.

In FIG. 7, the common electrode selection signal caM of Mth line which is generated by the scanning data generation circuit DSS shown in FIG. 1 generates delayed signals caM', caM" and caM⁻matched with selection starting timing of the common electrode of Mth line by delay circuits provided to the level shifter LS.

The common electrode polarity selection signal M arranges the timing of the delayed signals using a flip-flop circuit FF in FIG. 7. In place of the flip-flop circuit FF, a circuit having the same function as the flip-flop circuit FF can be used.

The above-mentioned delayed signals caM', caM" and caM, the common electrode polarity selection signal M and the common electrode selection signal caM are used to respectively output the level selection control signals caMH, caMm, caML, cbM through the AND circuit, the OR circuit and the inverting exclusive circuit OR.

The level selection control signals caMH, caMm, caML, cbM are respectively inputted to a common voltage output circuit COP (a circuit constitution thereof shown in FIG. 6) provided to the common-side liquid crystal driving circuit CD in FIG. 1. Here, when the common electrode of (M−1)th line is selected and the common electrode of Mth line is at the high level, the level selection control signal ca(M−1)H becomes high level and only the analogue switch swH(M−1) becomes the ON state, the voltage VH is applied to the common electrode of (M−1)th line. With respect to the other common electrodes, the level selection control signals caMm (here, M=1 to N, provided that (M−1) being extruded) becomes the high level and the analogue switches swcM which respectively correspond to these common electrodes become the ON state and the voltage Vm is applied to these common electrodes.

The operational waveforms of the circuit shown in FIG. 7 are explained hereinafter in conjunction with timings designated by encircled numerals respectively in FIG. 8. The operational waveforms corresponding to the respective timings will be explained for every timing specified by the numeral in a circle shown in FIG. 8 (each of following numerals shown in parentheses, in this specification). In FIG. 8, (1) when the latching pulse CL1 (FIG. 5) selects the Mth line (specified line adjacent to the above-mentioned (M−1)th line), the common electrode selection signal caM is inputted to the level shifter LS. Although the level selection control signals caMm which is changed to the low level is outputted from the level shifter LS and turns off the analogue switch swmM, the potential of the common electrode is held at the same level when the common electrode of (M−1)th line is selected. Here, the delayed level selection control signal ca(M−1)H is changed to the low level by the common electrode selection signal ca(M−1), and the analogue switch swH(M−1) is turned off.

Subsequently, (2) the delayed level selection control signal cbM which is changed to the high level turns on the analogue switch swcM and hence, the charge of the common electrode of (M−1)th line is gradually made to flow into the common electrode of Mth line so that both of these common electrodes approach a given potential.

(3) The level selection control signal cbM returns to the low level in response to the delayed level selection control signal caM' and the analogue switch swcM is turned off so that the potentials of the common electrodes of (M−1)th line and Mth line are held at a given level for some time.

(4) Subsequently, since the common electrode polarity selection signal is at the high level, the level selection control signal caMa which is changed to the high level turns on the analogue switch swHM so that the voltage VH is applied to the common electrode of Mth line. On the other hand, the delayed output ca(M−1)m is changed to the high level and turns on the analogue switch swm(M−1) at the same timing so that the voltage Vm is applied to the common electrode of (M−1)th line.

(5) When the latching pulse CL1 selects (M+1)th line (specified line adjacent to the above-mentioned Mth line), the common selection signal ca(M+1) is inputted to the level shifter LS(FIG. 1). Although the common selection signal ca(M+2)m which is changed to the low level is turned off with respect to the level shifter LS first of all, the potential of the common electrode is held at the same level as in the case in which the Mth line is selected.

(6),(7) Subsequently, although the delayed output ca(M+1) is changed to the high level, since the common electrode polarity selection signal M is changed from the high level to the low level, the common selection signal cb(M+1) is held at the low level.

(8) Subsequently, since the common electrode polarity selection signal M is at the low level, the delayed output ca(M+1)H which is changed to the high level makes the analogue switch swL(M+1) turn on and hence, the voltage VL is applied to the common electrode of (M+1)th line. On the other hand, the level selection control signal caMm is changed to the high level at the approximately same timing and hence, the analogue switch swmM is turned on and the voltage Vm is applied to the common electrode of Mth line.

As mentioned above, the liquid crystal display device according to this embodiment comprises the first switching circuit including pairs of the analogue switching elements consisting of swaN (N=1 to N) and swbN (N=1 to N) each, being provided for respective outputs ctM (M=1 to N) of the common electrodes, and varying the voltage applied to the output ctM between the first level (high level: selection voltage Va) and the second level (low level: non-selection voltage Vb), and the second switching circuit including analogue switching elements swcN (N=1 to N) disposed between respective pairs of the outputs ctM and turning off the common electrode of Mth line by separating the common electrode of Mth from the power source temporarily when the voltage applied thereto changes over between the first level and the second level, so that one of the common electrodes can be prevented from being connected to a plurality of power supplies simultaneously. Furthermore, the increase of consumptive electricity appearing particularly in the alteration timing driving using the alternation according to the aforementioned related art can be suppressed by short-circuiting some specified common electrodes.

Figure 9:
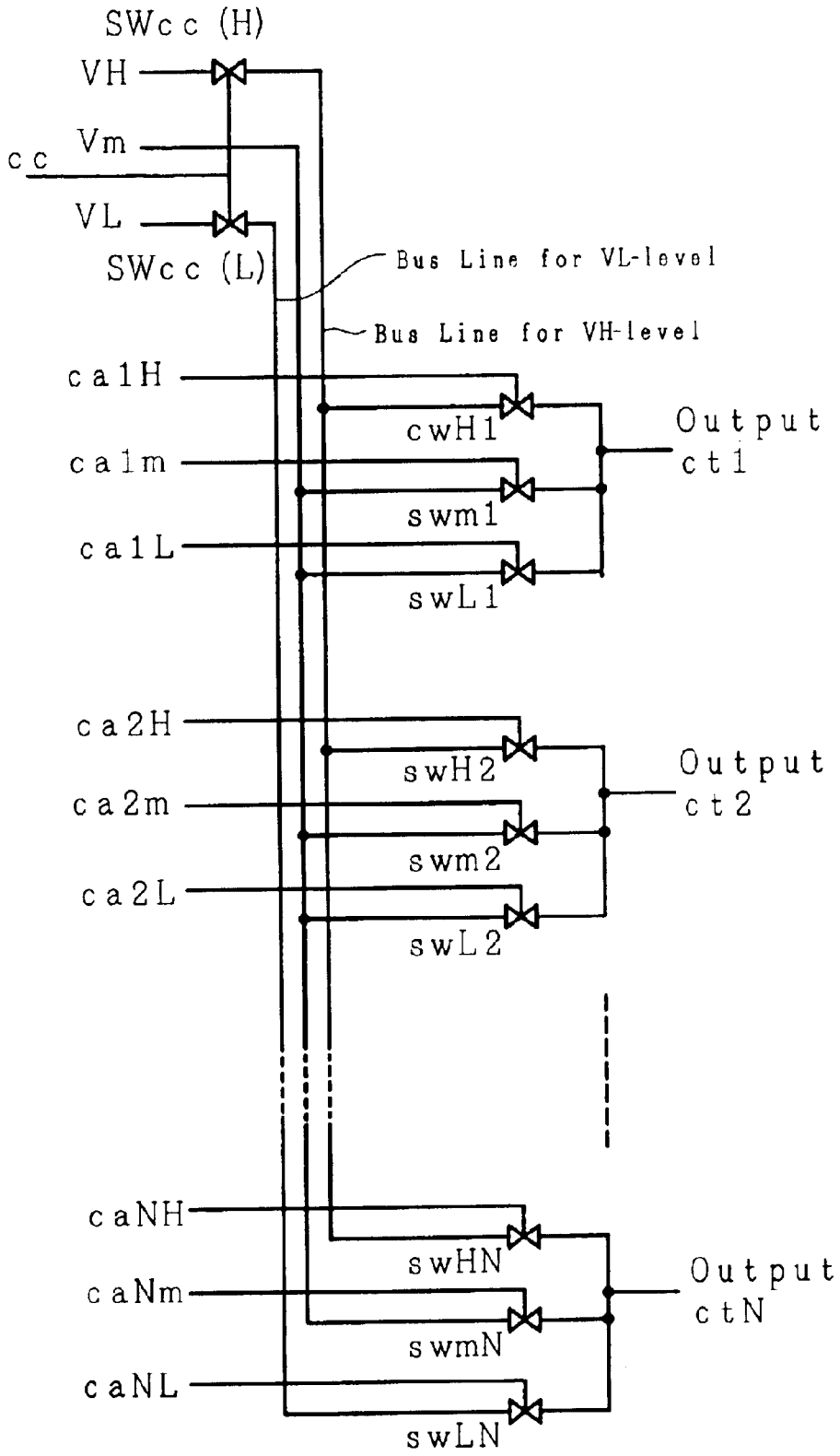
FIG. 9 is a circuit constitutional view of an output part which is served for explaining the third embodiment of the present invention.
Figure 10:
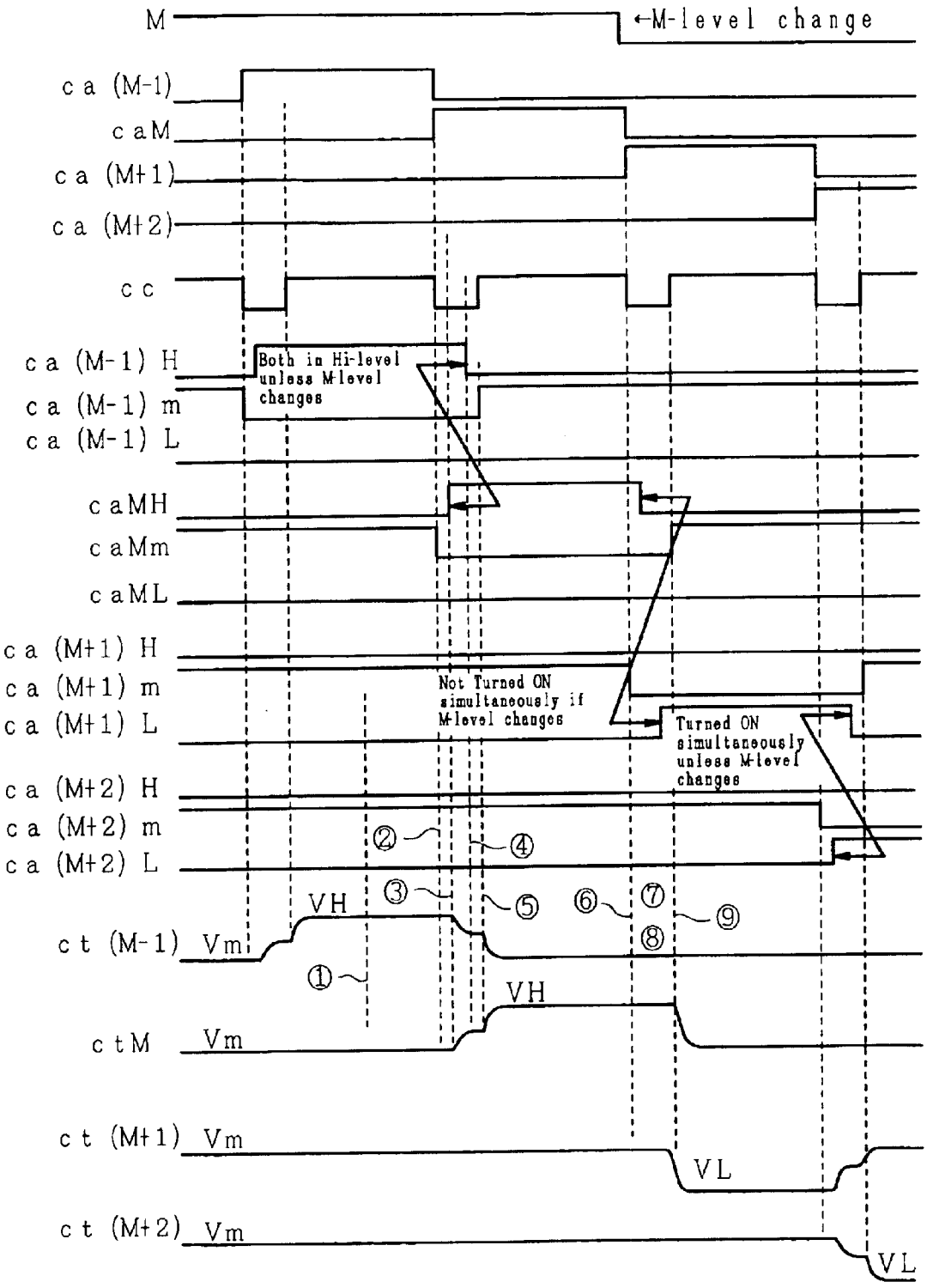
FIG. 10 is a waveform chart for explaining an operational timing of the circuit shown in FIG. 9.
Figure 11:
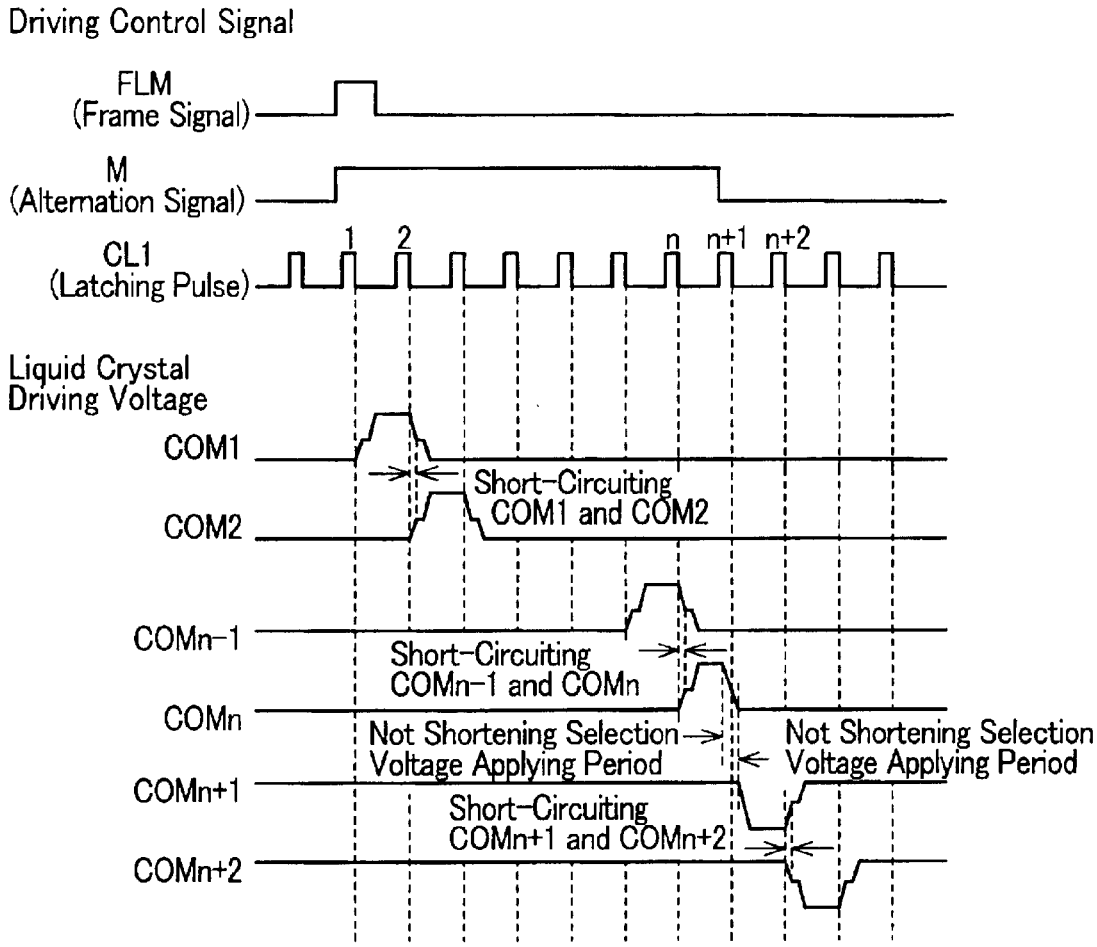
FIG. 11 is a waveform chart showing waveforms when common electrodes are short-circuited only at proper timings in the alternation driving.

FIG. 9 is a circuit constitutional view of an output part for explaining the third embodiment of the present invention, FIG. 10 is a waveform chart for explaining the timing, and FIG. 11 is a waveform chart when common electrodes are short-circuited only at the proper timing in the alternation driving.

In the output circuit shown in FIG. 9, analogue switches swcc(H), swcc(L) are respectively connected in series to the the first level voltage (high level) VH and the second level voltage (low level) VL and the first level voltage VH and the second level voltage VL are alternately changed over in response to ON-OFF control signals cc.

The outputs ct1 to ctN comprise first analogue switching circuits each of which is constituted of a pairs of analogue switches swH1 and swL1 to swHN and swLN and second analogue switching circuits each of which is constituted of an analogue switche swm arranged in parallel with the pair of analogue switches with respect to each output, respectively.

caM in FIG. 10 indicates a common electrode selection signal of Mth line which is generated by the scanning data generation circuit DSS shown in FIG. 1. First of all, (1) at the timing that the the common electrode selection signals ca(M−1), cc are at the high level, the ca(M−1)H becomes the high level and the voltage VH is outputted to the common electrode output ct(M−1) of (M−1)th line.

(2) When the latching pulse CL1 (see FIG. 5) selects the Mth line (specified line adjacent to the above-mentioned (M−1)th line), although the common level control signal caMm is changed to the low level and the analogue switch swmM is turned off, the potential of the common electrode is held at the same level when the common electrode of (M−1)th line is selected. Here, although the ON-OFF control signals cc of voltages VH, VL are changed to the low level and the analogue switches swcc(H), swcc(L) are turned off, the potential of the common electrode is held at the same level when the common electrode of (M−1)th line is selected in the same manner.

(3) Subsequently, the delayed level selection control signal caMH which is changed to the high level turns on the analogue switch swHM and hence, the output ct(M−1) and the output ctM are connected to each other through a bus line for VH level (FIG. 9). Due to this connection, the charge of the common electrode of (M−1)th line is gradually made to flow into the common electrode of Mth line so that both of these common electrodes approach a given potential respectively.

(4) Subsequently, the level selection control signal ca(M−1)H is changed to the low level, the analogue switch swH(M−1) is turned off. Although the potentials of the common electrodes of (M−1)th line and Mth line are held at a given level for some time, (5) the ON-OFF control signal cc is changed to the high level and the analogue switches swcc(H), swcc(L) are turned on. Since a VH power source is connected to the bus line for VH level, the voltage VH is applied to the output ctM, that is, the common electrode of Mth line.

Further, the level selection control signal ca(M−1)m is changed from the low level to the high level and the voltage Vm is applied to the common electrode of (M−1)th line.

(6) When the latching pulse CL1 selects the (M+1)th line (specified line adjacent to the above-mentioned Mth line), although the common level selection control signals ca(M+1)m is changed to the low level and the analogue switch swm(M+1) is turned off, the potential of the common electrode is held respectively at the same level when the common electrode of Mth line is selected. Here, although the ON-OFF control signals cc of voltages VH, VL are changed to the low level and the analogue switches swcc(H), swcc(L) are turned off, the potential of the common electrode is held at the same level when the common electrode of Mth line is selected in the same manner.

(7) Subsequently, when the common electrode polarity selection signal M is changed from the high level to the low level, the level selection control signal caMH is changed from the high level to the low level so that the analogue switch swHM is turned off. Accordingly, although the output ctM is separated from the connection with the bus line for VH level, the potential of the common electrode of Mth line is held at the same level when the Mth line is selected.

(8) Subsequently, the level selection control signal ca(M+1)L is changed to the high level and the analogue switch swL(M+1) is turned on and hence, the output ct(M+1) is connected to the bus line for VL level. Since the power source is not yet connected to the bus line for VL level, the potential of the common electrode of (M+1)th line is held at the same level when the Mth line is selected.

(9) The ON-OFF control signal cc is changed to the high level and the analogue switches swcc(H), swcc(L) are turned on. Since a VL power source is connected to the bus line for VH level, the voltage VL is applied to the output ct (M+1), that is, the common electrode of (M+1)th line.

Further, the level selection control signal caMm is changed from the low level to the high level and the voltage Vm is applied to the common electrode of Mth line.

FIG. 11 is a waveform chart similar to that of FIG. 5 obtained by short-circuiting the common electrodes only at the proper timing in the alternation driving for explaining the second embodiment of the present invention. FIG. 11 shows the timing waveforms for solving the tasks in the alternation driving as explained in conjunction with FIG. 10.

As shown in FIG. 11, although the common electrodes (COM1 and COM2, COMn−1 and COMn, COMn+1 and COMn+2 in the drawing) whose applied voltages are changed are short-circuited when the polarities of the alternation are not changed, these common electrodes are not short-circuited when the polarities are changed(COMn and COMn+1 in the drawing). In addition to the above, by suitably shortening the period for applying selection voltages (COMn, COMn+1 in the drawing), the effective value voltages which are applied to respective lines can be made substantially equal and hence, the increase of the consumptive electricity in the conventional technique which is derived from the alternation can be suppressed.

Figure 12:
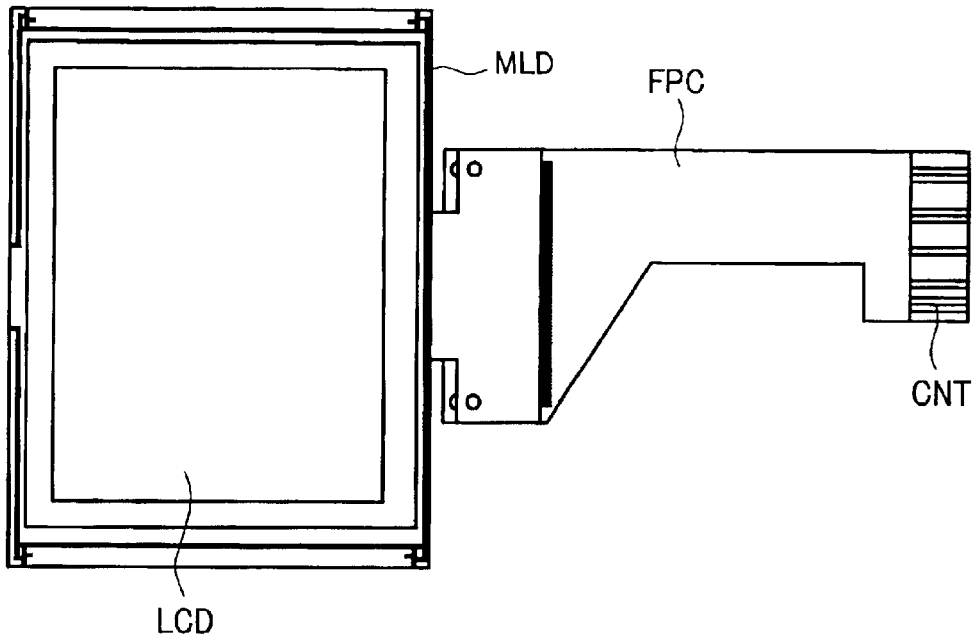
FIG. 12 is a plan view of a liquid crystal display device according to the present invention.
Figure 13:
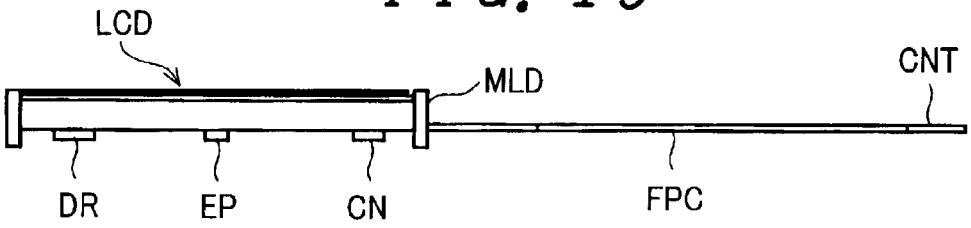
FIG. 13 is a side view showing the liquid crystal display device shown in FIG. 12.
Figure 14:
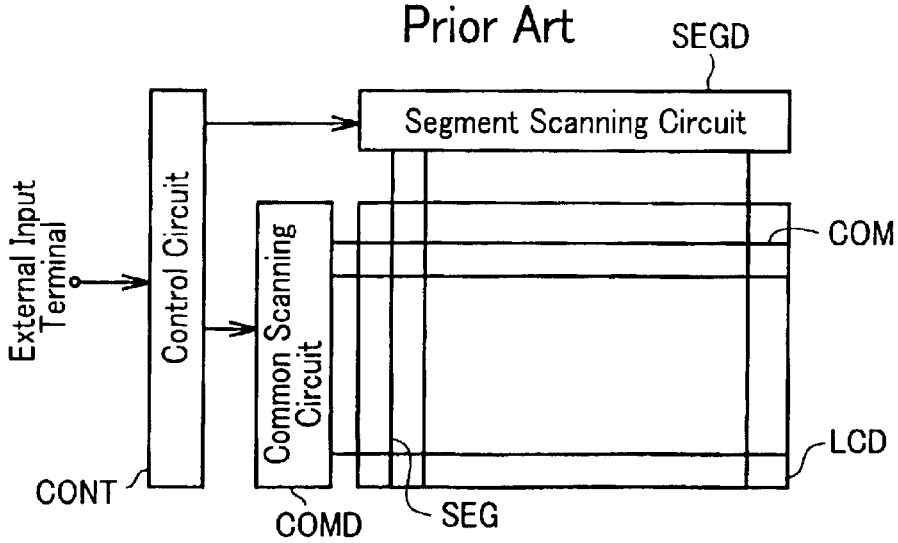
FIG. 14 Prior Art
FIG. 14 is a schematic view for explaining a driving system of an STN type liquid crystal panel.
Figure 16:
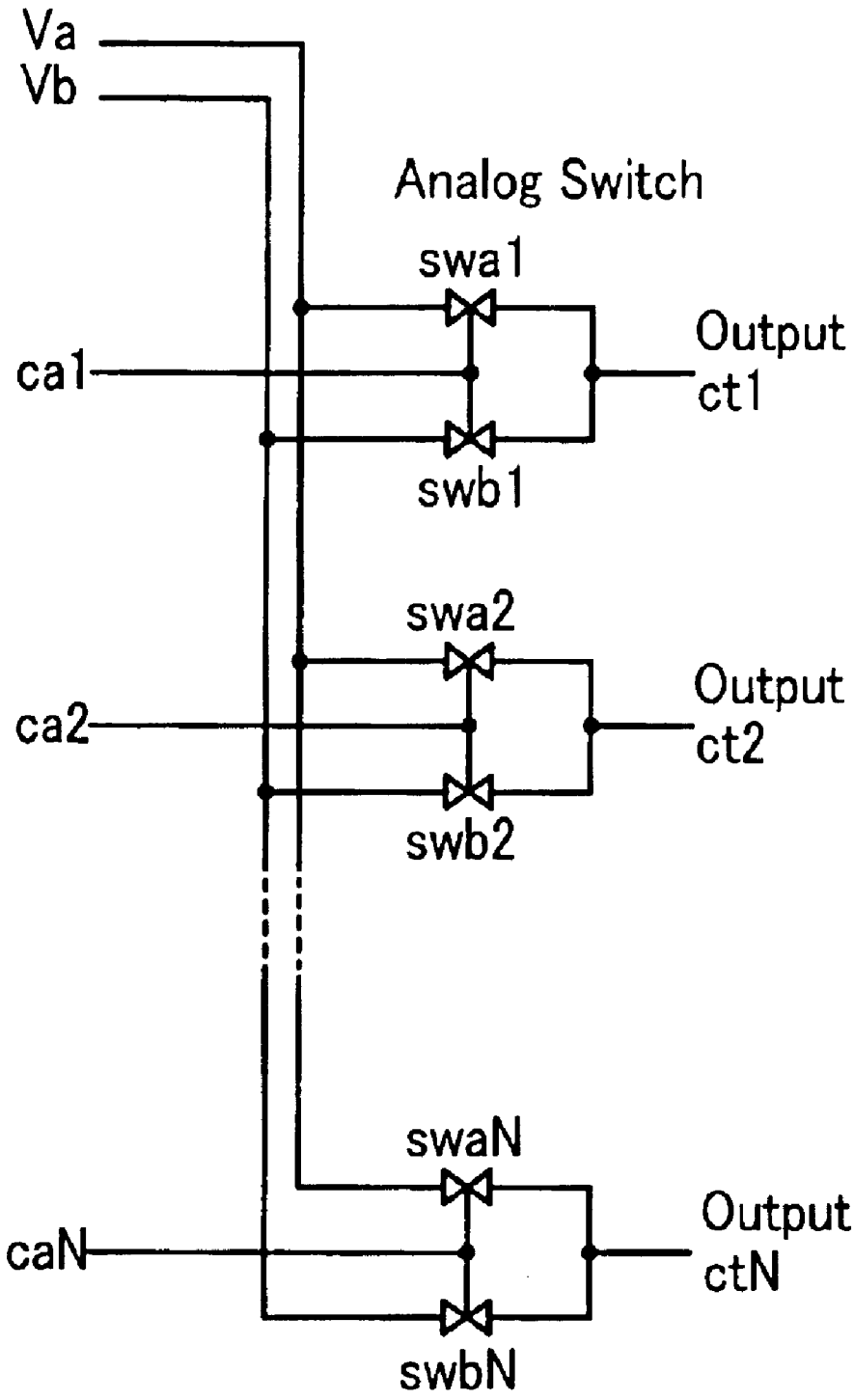
FIG. 16 Prior Art
FIG. 16 is a circuit diagram for generating the driving waveforms shown in FIG. 15B.
Figure 17:
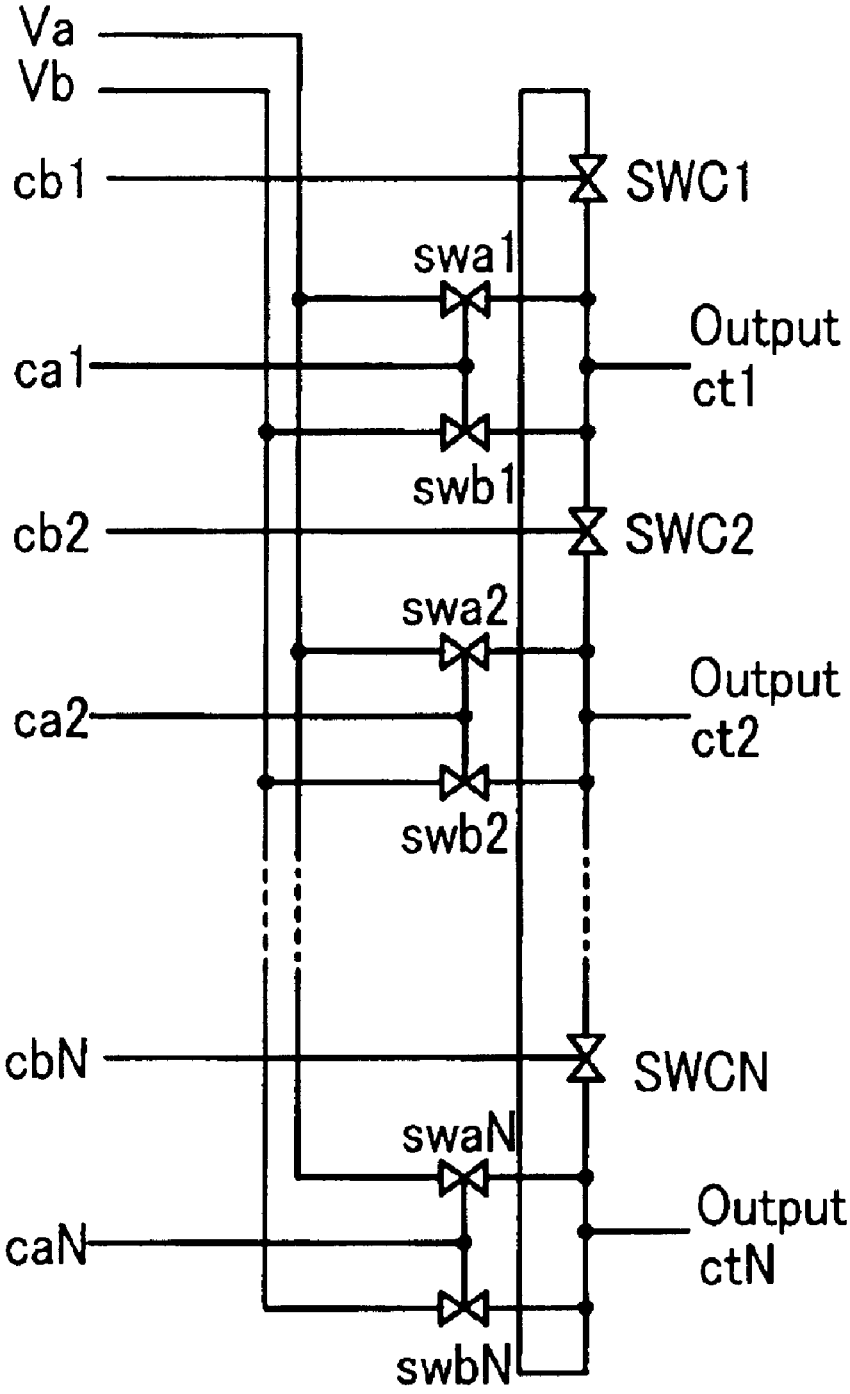
FIG. 17 Prior Art
FIG. 17 is a circuit diagram for generating the driving waveforms shown in FIG. 15C.

Subsequently, an example of a liquid crystal display device to which the present invention is applied is explained. FIG. 12 is a plan view of the liquid crystal display device according to the present invention and FIG. 13 is a side view of the liquid crystal display device. This liquid crystal display device is used as display means for a portable telephone.

The liquid crystal display device is housed in a casing (mold) MLD and a liquid crystal panel LCD thereof is exposed on a surface thereof as a display screen. Electricity necessary for display data and driving of the liquid crystal display device is supplied from a host computer side not shown in the drawing through a flexible printed circuit board FPC. A symbol CNT indicates a terminal part which is connected to a connector of the host computer side.

The flexible printed circuit board FPC is connected to a connector CN mounted on a printed circuit board not shown in the drawing which is arranged at a back surface of the liquid crystal display device. On this printed circuit board, driving ICs which constitute the above-mentioned common driver having the common voltage output part and the segment driver and various kinds of parts EP are mounted.

With the use of such a liquid crystal display device, the reduction the consumptive electricity of the portable telephone can be realized.

As has been explained heretofore, according to the present invention, by short-circuiting some specified common electrodes which constitute the liquid crystal panel, particularly, the increase of the consumptive electricity in the conventional technique which is derived from the alternation at the alternation timing driving can be suppressed. Accordingly, the operable time of a portable telephone or a portable information terminal having a small battery capacitance can be prolonged or extended. Further, with respect to the portable telephone having the same capacitance and the standby time, a liquid crystal display device which can make an appliance light-weighted can be provided.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

What is claimed is:

1. A liquid crystal display device comprising:

a liquid crystal panel which juxtaposes a plurality of common electrodes extended in the first direction on one of a pair of substrates sandwiching a liquid crystal layer therebetween and juxtaposes a plurality of segment electrodes extended in the second direction transverse to the first direction on the other of the pair of these substrates, a common driver having a common voltage output part which applies scanning signals to the plurality of respective common electrodes, and a segment driver having a segment voltage output part which applies data signals corresponding to display data to the plurality of respective segment electrodes, wherein the common driver has following functions:

(a) to allocate selection periods sequentially to the plurality of respective common electrodes and to apply a selection voltage to one of the plurality of common electrodes to which non-selection voltage is applied as scanning signals in a period in which the data signals are applied to the plurality of segment electrodes;

(b) to apply the scanning signal to a $n_M$th one of the plurality of common electrodes to which the Mth selection period (M being a natural number of 2 or more) is allocated performed in sequence of (i) ceasing the application of the non-selection voltage to the nMth of common electrode at a first time when the Mth selection period is started, (ii) starting the application of the selection voltage thereto from the second time coming after the first time, (iii) ceasing the application of the selection voltage thereto at the third time when the Mth selection period expires, and (iv) starting the application of the non-selection voltage thereto from the fourth time coming after the third time;

(c) to comparing polarity of the selection voltages in the Mth selection period and in a (M−1)th selection period allocated prior to the Mth selection period to a $n_{M-1}$th common electrode and applied to the $n_{M-1}$th common electrode, respectively for the non-selection voltage;

(d) to short-circuit a portion of the common voltage output part corresponding to the $n_M$th common electrode and another portion thereof corresponding to the $n_{M-1}$th common electrode during a period lying between the first time and the second time, when the selection voltage in the Mth selection period and the selection voltage in the (M−1)th selection period have the same polarity, and (e) not to short-circuit the portion of the common voltage output part corresponding to the $n_M$th common electrode and the another portion thereof corresponding to the $n_{M-1}$th common electrode during the period lying between the first time and the second time, when the selection voltage in the Mth selection period and the selection voltage in the (M=1)th selection period have the polarities opposite to each other.

2. A liquid crystal display device according to claim 1, wherein the common voltage output part which corresponds to the $n_M$th common electrode and the common voltage output part which corresponds to the $n_{M-1}$th common electrode are short-circuited in the period after the first time and before the second time.

3. A liquid crystal display device according to claim 1, wherein the period in which the common voltage output part which corresponds to the $n_M$th common electrode and the common voltage output part which corresponds to the $n_{M-1}$th common electrode are short-circuited expires after the third time and before the fourth time.

4. A liquid crystal display device according to claim 1, wherein, in the liquid crystal panel, the $n_M$th common electrode and the $n_{M-1}$th common electrode are arranged adjacent to each other.

5. A liquid crystal display device according to claim 1, wherein, in the liquid crystal panel, the $n_M$th common electrode and the $n_{M-1}$th common electrode are arranged in a spaced-apart manner.

* * * * *